US011384598B2

(12) United States Patent
Toda et al.

(10) Patent No.: US 11,384,598 B2
(45) Date of Patent: Jul. 12, 2022

(54) SCREEN DEVICE

(71) Applicant: SEIKI HANBAI CO., LTD., Tokyo (JP)

(72) Inventors: Hirotsugu Toda, Tokyo (JP); Masato Moriya, Tokyo (JP)

(73) Assignee: SEIKI HANBAI CO., LTD., Tokyo (JP)

( * ) Notice: Subject to any disclaimer, the term of this patent is extended or adjusted under 35 U.S.C. 154(b) by 619 days.

(21) Appl. No.: 16/085,824

(22) PCT Filed: Mar. 16, 2017

(86) PCT No.: PCT/JP2017/010558

§ 371 (c)(1),
(2) Date: Sep. 17, 2018

(87) PCT Pub. No.: WO2017/164047

PCT Pub. Date: Sep. 28, 2017

(65) Prior Publication Data

US 2019/0048659 A1 Feb. 14, 2019

(30) Foreign Application Priority Data

Mar. 24, 2016 (JP) ..... JP2016-060448

(51) Int. Cl.
*E06B 9/54* (2006.01)
*E06B 9/02* (2006.01)
*E06B 9/58* (2006.01)

(52) U.S. Cl.
CPC ..... *E06B 9/54* (2013.01); *E06B 9/02* (2013.01); *E06B 9/58* (2013.01); *E06B 2009/543* (2013.01)

(58) Field of Classification Search
CPC ..... E06B 9/02; E06B 2009/543; E06B 9/06; E06B 9/52; E06B 9/54; E06B 9/58
See application file for complete search history.

(56) References Cited

U.S. PATENT DOCUMENTS 6,978,820 B2 * 12/2005 Aoki ..... E06B 9/262 160/84.06
7,984,744 B2 * 7/2011 Karasawa ..... E06B 9/522 160/84.06

(Continued)

FOREIGN PATENT DOCUMENTS

JP 2004-346578 A 12/2004
JP 2005-023578 A 1/2005
JP 2015-172316 A 10/2015

OTHER PUBLICATIONS

PCT; App. No. PCT/JP2017/10558; International Search Report dated Apr. 25, 2017; pp. 1-8.

*Primary Examiner* — Johnnie A. Shablack
*Assistant Examiner* — Matthew R. Shepherd
(74) *Attorney, Agent, or Firm* — Fitch, Even, Tabin & Flannery LLP

(57) ABSTRACT

There is provided a screen guide that engages a support rail or is detachable from the support rail at an intermediate position on the support rail. The support rail supports the screen guide and includes first and second engagement edges, and the screen guide is formed by connecting a plurality of guide pieces to one another in series. Each of the guide pieces includes a piece body that engages an end portion of a screen and an engagement member that includes first and second engagement portions that engage the first and second engagement edges of the support rail, respectively. Each of the engagement members is coupled to the corresponding piece body such that the engagement member is capable of being displaced to a first position at which the first and second engagement portions engage the first and second engagement edges, respectively, and to a second, detached position.

10 Claims, 15 Drawing Sheets

(56) References Cited

U.S. PATENT DOCUMENTS

| | | | | |
|---|---|---|---|---|
| 8,925,614 | B2 * | 1/2015 | Okachi | E06B 9/54 160/31 |
| 2006/0162871 | A1 * | 7/2006 | Kamosawa | E06B 9/52 160/84.06 |
| 2007/0039698 | A1 * | 2/2007 | Chino | E06B 9/54 160/84.06 |
| 2007/0068633 | A1 * | 3/2007 | Chino | E06B 9/52 160/31 |
| 2009/0145560 | A1 * | 6/2009 | Donatelli | E06B 9/54 160/323.1 |
| 2010/0252210 | A1 * | 10/2010 | Roberts | E06B 9/58 160/84.04 |
| 2016/0002973 | A1 * | 1/2016 | Grun | E06B 9/06 49/50 |

* cited by examiner (a)

(b)

(a)

(b)

(a)

(b)

(a)

(b)

SCREEN DEVICE

CROSS-REFERENCE TO RELATED APPLICATIONS

This application is a U.S. national phase application of International Application No. PCT/JP2017/010558, filed Mar. 16, 2017, designating the United States, which claims priority to Japanese Patent Application No. 2016-060448, filed Mar. 24, 2016.

TECHNICAL FIELD

The present invention relates to a screen device that is installed in a building opening for blocking light, insulating against heat, screening from view, protecting against insects, preventing entry of pollen, and so forth.

BACKGROUND ART

A screen device in which a screen for blocking light, insulating against heat, screening from view, protecting against insects, preventing entry of pollen, and so forth is stretched in a screen frame that is installed in a building opening and in which the screen is operated to be opened and closed by using an operating stile capable of moving side to side within the screen frame is commonly known.

The screen device includes a screen guide that supports upper and lower ends of a screen stretched in the screen frame. The screen guide prevents the screen from being greatly deflected as a result of an action force generated by, for example, wind acting on the screen and is formed by connecting a plurality of guide pieces to one another in series such that the screen guide is capable of being bent. The screen guide is disposed linearly along an end portion of the screen so as to linearly support the end portion of the screen.

As illustrated in FIG. 23, the screen guide 60 is supported by a rail 62, which is horizontally disposed on the lower side portion of the screen frame, by fitting the rail 62 into recessed grooves 64, which are formed in bottom surfaces of the guide pieces 63, in order to prevent the screen guide 60 from being displaced together with the screen 61 when the screen 61 receives a lateral force. In this case, in order to cause the screen guide 60 to be supported by the rail 62 with higher certainty, it is desired that the rail 62 include a pair of engagement edges 62*a* and 62*a* formed so as to protrude in a widthwise direction of the rail 62, that a pair of engagement hooks 64*a* and 64*a* be formed on groove walls of each of the recessed grooves of the guide pieces 63, and that the engagement hooks 64*a* and 64*a* engage the engagement edges 62*a* and 62*a*.

Regarding the screen guide, there are two types of screen guides including a screen guide (of a first type) that is led out from and is introduced into an operating stile as a screen is operated to be opened and closed and a screen guide (of a second type) that is led out from and is introduced into one of left and right vertical-frame poles (fixed frames) of screen frame.

However, the configuration of the rail 62 and the configuration of each of the guide pieces 63 that are illustrated in FIG. 23 can be applied only to the screen guide of the second type, which is one of the above-mentioned two types of screen guides. This is because the gap between the pair of engagement hooks 64*a* and 64*a* of each of the guide pieces 63 is smaller than the distance between the end portions of the pair of engagement edges 62*a* and 62*a* of the rail, and thus, the pair of engagement hooks 64*a* and 64*a* always need to engage the engagement edges 62*a* and 62*a* from an end portion of the rail 62 in the lengthwise direction of the rail 62 and cannot engage the engagement edges at an intermediate position on the rail.

Consequently, it is desired that the configuration of the rail 62 and the configuration of each of the guide pieces 63, which are illustrated in FIG. 23, can also be applied to the screen guide of the first type, that is, the type of screen guide that is drawn into and is drawn out from an operating stile that moves along a rail.

SUMMARY OF INVENTION

Technical Problem

It is a technical object of the present invention to configure a screen guide that is drawn into an operating stile and is drawn out from the inside of the operating stile as a screen is operated to be opened and closed by the operating stile to be capable of engaging a support rail and detached from the support rail at an intermediate position on the support rail.

Solution to Problem

To solve the above-described problem, a screen device according to the present invention includes a screen frame that is installed in a building opening; an operating stile that is vertically disposed in the screen frame and is capable of being operated to move side to side; a screen that is stretched between one of left and right vertical-frame poles of the screen frame and the operating stile and that opens and closes the screen frame as a result of the operating stile being operated and moved; a screen guide that is provided at least one of upper and lower ends of the screen and that is drawn out from the inside of the operating stile along an end portion of the screen and is drawn into the inside of the operating stile as a result of the operating stile being operated and moved; and a support rail that linearly supports, along the screen, the screen guide that is drawn out from the inside of the operating stile. The support rail includes a first engagement edge and a second engagement edge that protrude in a widthwise direction of the support rail in such a manner as to face away from each other. The screen guide is formed by connecting a plurality of guide pieces to one another in series such that the screen guide is capable of being bent only in one direction. Each of the guide pieces includes a piece body that engages the end portion of the screen and an engagement member including a first engagement portion and a second engagement portion that engage the first engagement edge and the second engagement edge of the support rail, respectively. The engagement member is coupled to the piece body in such a manner as to be capable of being displaced to a first position at which the first engagement portion and the second engagement portion engage the first engagement edge and the second engagement edge of the support rail, respectively, and to a second position at which the first engagement portion and the second engagement portion are respectively detached from the first engagement edge and the second engagement edge.

According to the present invention, it is desirable that each of the engagement members have a recessed support groove into which the support rail is fitted, and it is desirable that the first engagement portion be formed on a first groove wall, which is one of a pair of opposing groove walls of the support groove, and that the second engagement portion be formed on a second groove wall, which is another one of the pair of opposing groove walls.

It is further desirable that the first engagement portion and the second engagement portion include engagement hooks each projecting inward in a widthwise direction of the support groove so as to engage one of the first engagement edge and the second engagement edge and that at least one of either inner surfaces of the engagement hooks or rear surfaces of the engagement edges and at least one of either outer surfaces of the engagement hooks or front surfaces of the engagement edges be inclined in directions in which thicknesses of the engagement hooks or thicknesses of the engagement edges gradually decrease toward ends of the engagement hooks or ends of the engagement edges.

According to a specific configuration aspect of the present invention, the support groove is formed such that, when the screen guide is linearly supported along the support rail, the support groove is oriented in an oblique direction with respect the support rail, and a portion of the first groove wall and a portion of the second groove wall, which oppose each other, are in contact with the first engagement edge and the second engagement edge, respectively, and the first engagement portion is formed on the portion of the first groove wall that is brought into contact with the first engagement edge, and the second engagement portion is formed on the portion of the second groove wall that is brought into contact with the second engagement edge.

In this case, it is preferable that each of the guide pieces have a first end and a second end, which is opposite to the first end, in a direction along the support rail, and it is preferable that the first engagement portion be formed on one of the first end side and the second end side and that the second engagement portion be formed on another one of the first end side and the second end side.

In an embodiment of the present invention, the engagement member of each of the guide pieces may be configured to be coupled to the corresponding piece body in such a manner as to be rotatable about an axis that is perpendicular to the guide piece and may be configured to be displaced to the first position and to the second position by rotating in forward and reverse directions.

In another embodiment of the present invention, the engagement member of each of the guide pieces may include a pair of movable pieces that are capable of being displaced in a direction in which a gap between the pair of movable pieces changes. The first engagement portion may be formed on one of the pair of movable pieces, and the second engagement portion may be formed on another one of the pair of movable pieces.

In addition, according to the present invention, a screen-support mechanism supporting an end portion of a screen that is stretched in a screen frame of a screen device in such a manner as to be capable of being freely opened and closed is provided, the screen-support mechanism including a screen guide that supports the end portion of the screen and a support rail that supports the screen guide. The support rail includes a first engagement edge and a second engagement edge that protrude in a widthwise direction of the support rail in such a manner as to face away from each other. The screen guide is formed by connecting a plurality of guide pieces to one another in series such that the screen guide is capable of being bent only in one direction. Each of the guide pieces includes a piece body that engages the end portion of the screen and an engagement member including a first engagement portion and a second engagement portion that engage the first engagement edge and the second engagement edge of the support rail, respectively. The engagement member is coupled to the piece body in such a manner as to be capable of being displaced to a first position at which the first engagement portion and the second engagement portion engage the first engagement edge and the second engagement edge of the support rail, respectively, and to a second position at which the first engagement portion and the second engagement portion are respectively detached from the first engagement edge and the second engagement edge.

Advantageous Effects of Invention

According to the present invention, guide pieces that are included in a screen guide are each formed of a piece body and an engagement member, and each of the engagement members is capable of being displaced to a first position at which a first engagement portion and a second engagement portion engage a first engagement edge and a second engagement edge of a support rail, respectively, and to a second position at which the first engagement portion and the second engagement portion are respectively detached from the first engagement edge and the second engagement edge. Therefore, the guide pieces, that is, the screen guide can engage the support rail and can be detached from the support rail at an intermediate position on the support rail.

DESCRIPTION OF EMBODIMENTS

The drawings illustrate an embodiment of a screen device according to the present invention, and the screen device is used by being installed in a building opening, such as a window or an entrance of a building, for the purpose of blocking light, insulating against heat, screening from view, protecting against insects, preventing entry of pollen, and so forth.

Figure 1:
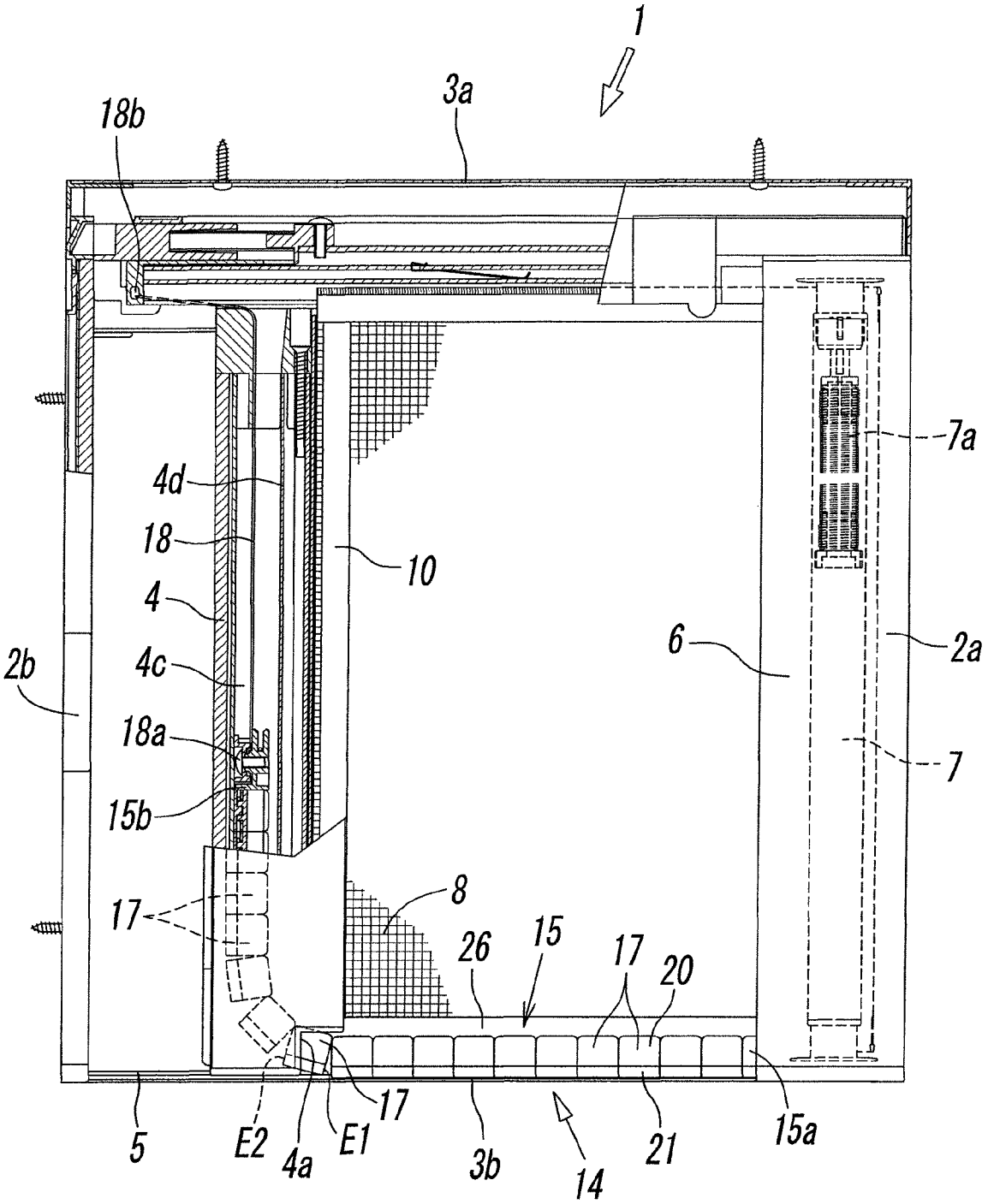
FIG. 1 is a front view illustrating, in a partially cutaway manner, a screen device according to the present invention when viewed from the inside of a room.
Figure 2:
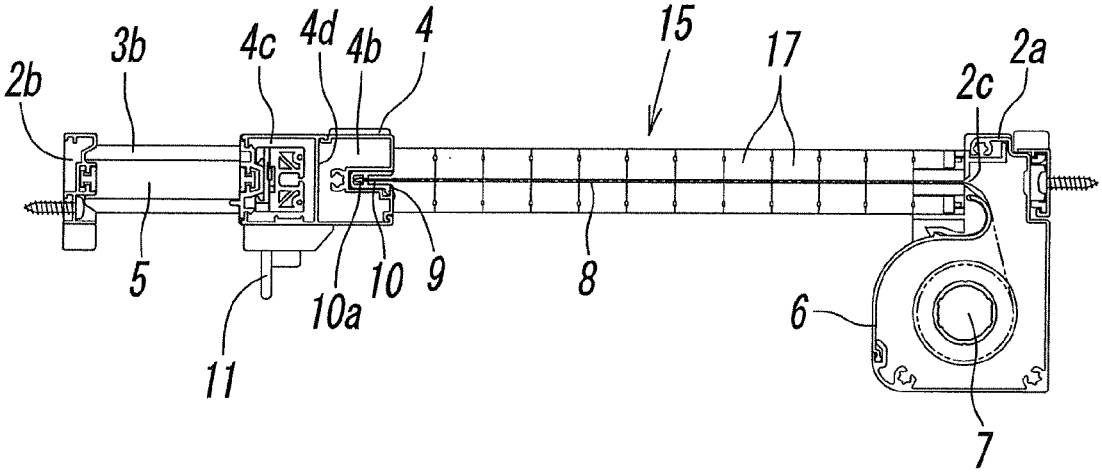
FIG. 2 is a cross-sectional plan view of the screen device illustrated in FIG. 1.
Figure 3:
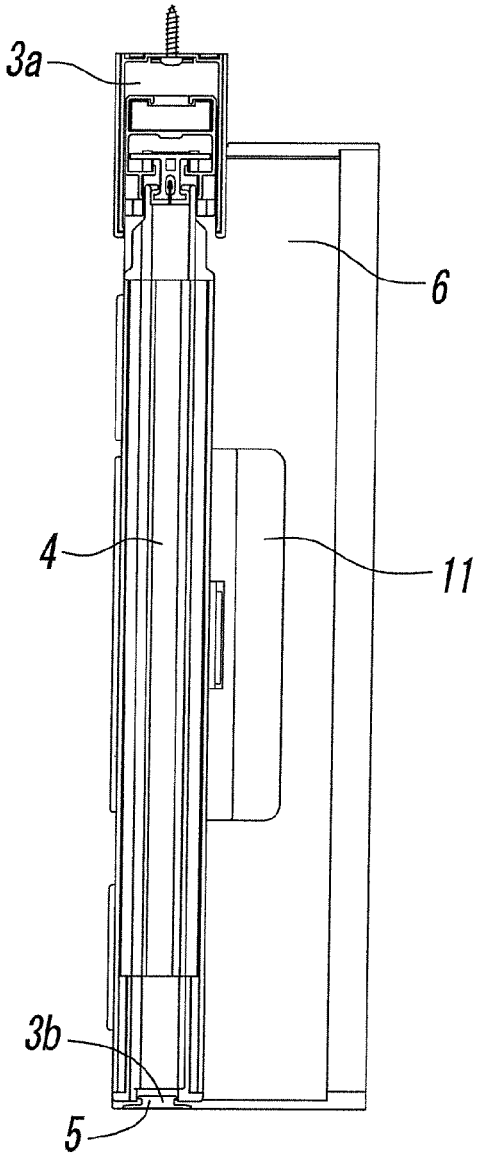
FIG. 3 is a side view of the screen device illustrated in FIG. 1.

As illustrated in FIG. 1 to FIG. 3, the screen device includes a rectangular screen frame 1 including a first vertical-frame pole 2*a* located on the right-hand side, a second vertical-frame pole 2*b* located on the left-hand side, an upper first horizontal-frame pole 3*a*, and a lower second horizontal-frame pole 3*b*. An operating stile 4 is vertically disposed in the screen frame 1 so as to be capable of being operated to move side to side in a state where an upper end of the operating stile 4 is supported by the first horizontal-frame pole 3*a* and where a lower end of the operating stile 4 is supported by a support rail 5, which is disposed on a top surface of the second horizontal-frame pole 3*b*.

In a winding box 6 that is formed on a front surface of the first vertical-frame pole 2*a*, the front surface facing toward the interior of a room, a winding shaft 7 is disposed so as to be rotatable about a vertical axis. A proximal end portion of a screen 8 is wound around the winding shaft 7, and a leading end portion of the screen 8 is led out from a slit-shaped opening 2*c* formed in an inner side surface of the first vertical-frame pole 2*a* toward the inside of the screen frame 1 and is connected to the operating stile 4. Accordingly, it can be said that the screen 8 is stretched between the first vertical-frame pole 2*a* and the operating stile 4.

Figure 4:
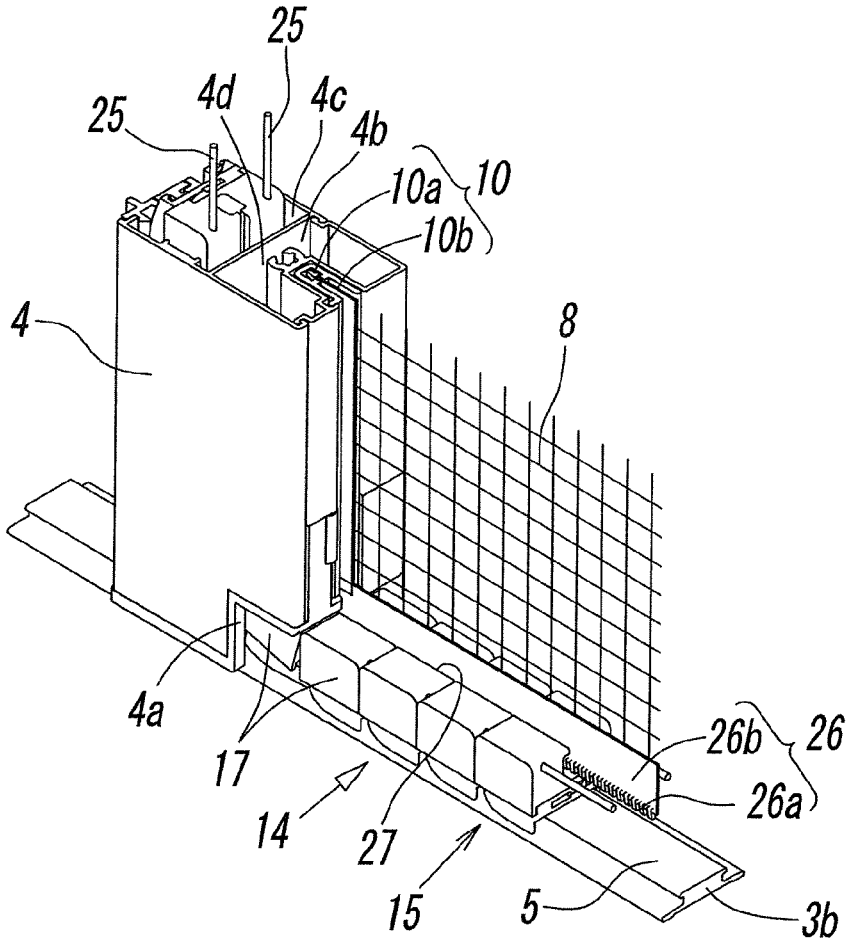
FIG. 4 is a partial perspective view of the screen device illustrated in FIG. 1.

As is clear from FIG. 2 and FIG. 4, the cross section of the operating stile 4 has a rectangular shape that is horizontally long. The operating stile 4 includes a screen-attachment portion 4*b* located on the side on which the first vertical-frame pole 2*a* is disposed and a screen-guide accommodating portion 4*c* located on the side on which the second vertical-frame pole 2*b* is disposed, and the screen-attachment portion 4*b* and the screen-guide accommodating portion 4*c* are partitioned by a partition wall 4*d*.

A slit-shaped connecting groove 9 is formed so as to vertically extend in an inner side surface of the screen-attachment portion 4*b*, the inner side surface facing toward the first vertical-frame pole 2*a*. A connecting member 10 that is attached to the leading end portion of the screen 8 is inserted into the connecting groove 9, and an engagement body 10*a* provided at an end of the connecting member 10 engages the inner edge of the connecting groove 9, so that the leading end of the screen 8 is connected to the operating stile 4.

The connecting member 10 is formed by fixing the engagement body 10*a* having a plurality of protrusions to an end of a tape-shaped base member 10*b*, and the base member 10*b* is joined to the leading end portion of the screen 8 by means of, for example, welding or sewing.

The winding shaft 7 winds up the screen 8 by using, as a winding force, an elastic force of a coil spring 7*a* built in the winding shaft 7. When the operating stile 4 is moved leftward in FIG. 1 such that the screen 8 is extended from the winding shaft 7, so that the winding force is accumulated as a result of the coil spring 7*a* being twisted, and when the operating stile 4 is moved rightward in FIG. 1 such that the screen frame 1 is opened, the screen 8 is wound up by the winding force accumulated in the coil spring 7*a*.

The member denoted by the reference sign 11 in FIG. 2 is a handle that is used for operating the operating stile 4 to be in an open position or a closed position.

The screen device further includes a screen-support mechanism 14 having a function of preventing the operating stile 4 from being inclined when the operating stile 4 is operated to be in the open position or the closed position and a function of preventing a lower end portion of the screen 8 from being deflected or displaced by the influence of wind or the like. The screen-support mechanism 14 includes a screen guide 15 uprightly supporting the lower end portion of the screen 8 and the support rail 5 supporting the screen guide 15 linearly along the screen 8.

Figure 8:
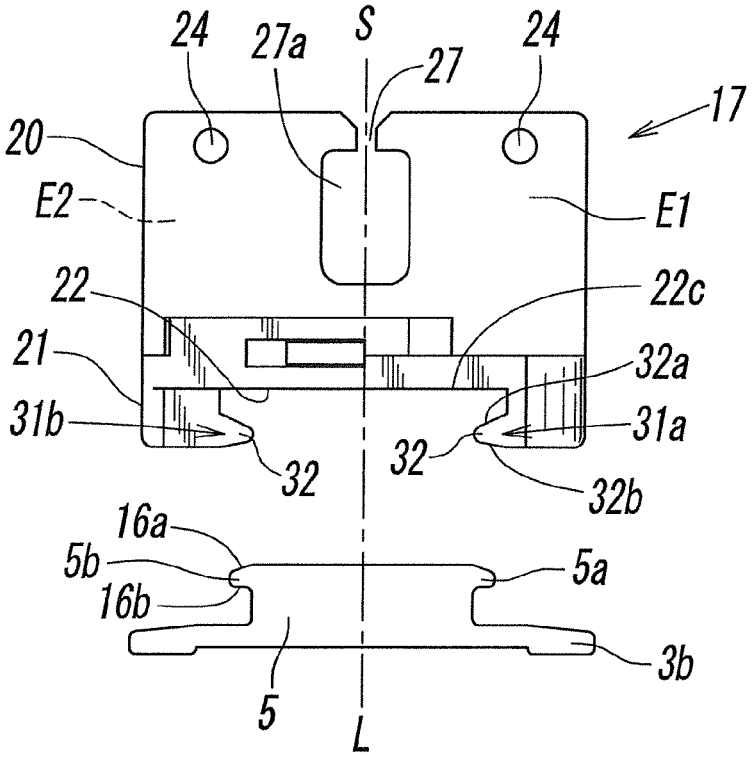
FIG. 8 is a front view of one of guide pieces and the rail.

As illustrated in detail in FIG. 8, the support rail 5 includes a flange-shaped first engagement edge 5*a* and a flange-shaped second engagement edge 5*b* that protrude in the widthwise direction of the support rail 5 so as to face away from each other. The first engagement edge 5*a* and the second engagement edge 5*b* each have a front surface 16*a* and a rear surface 16*b*. The front surface 16*a* of each of the first engagement edge 5*a* and the second engagement edge 5*b* is an inclined surface that is inclined in a direction in which the thickness of the engagement edge gradually decreases toward an end of the engagement edge, and in contrast, each of the rear surfaces 16*b* is a horizontal surface.

Figure 5:
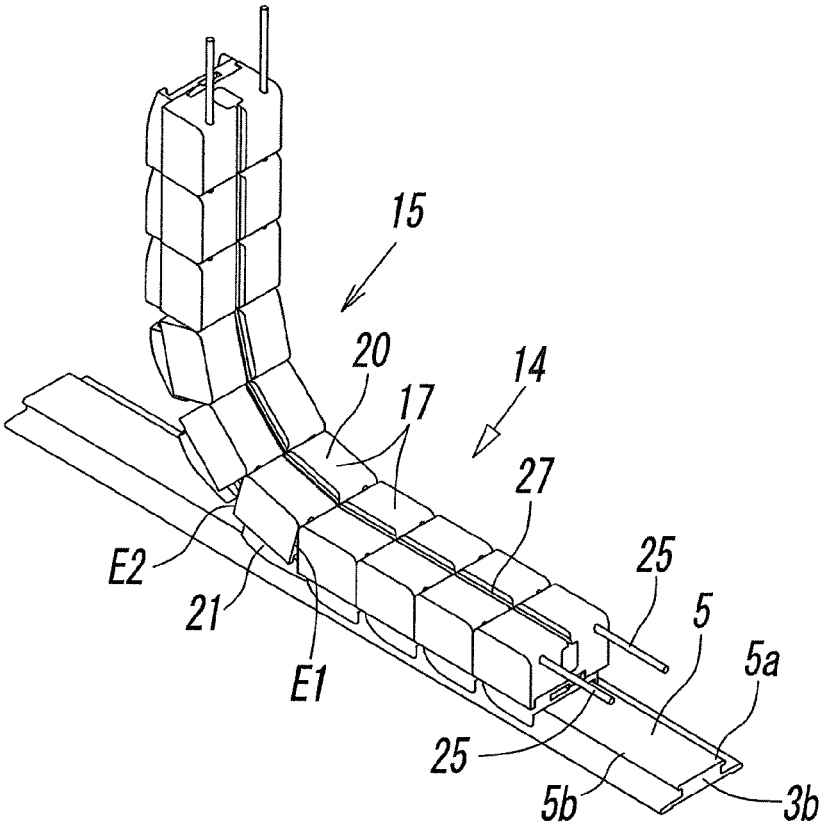
FIG. 5 is a perspective view of a screen guide and a rail separated from the screen device illustrated in FIG. 4.
Figure 6:
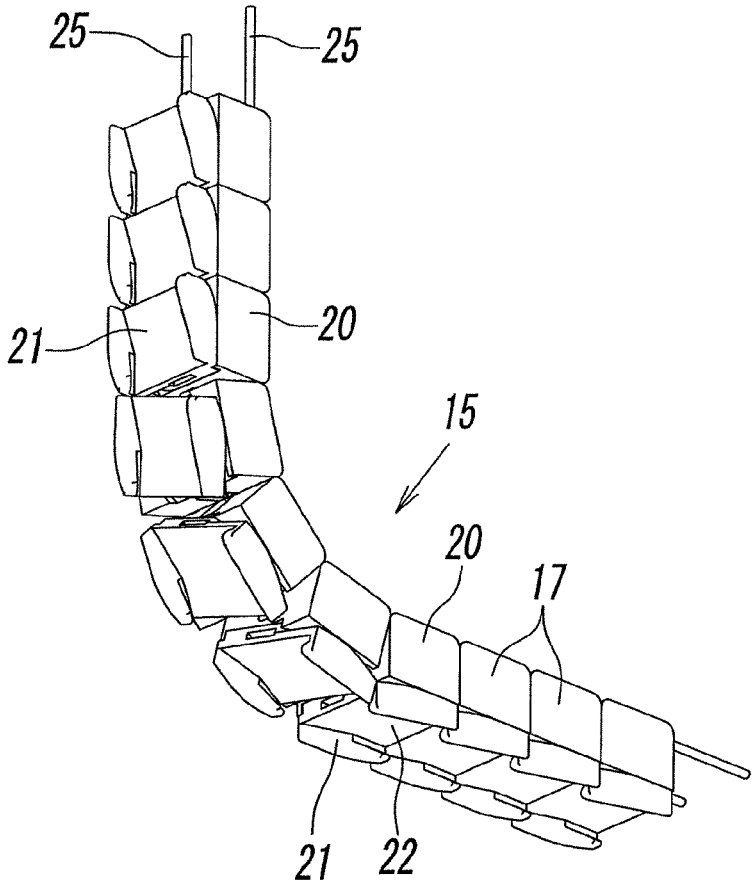
FIG. 6 is a perspective view of the screen guide illustrated in FIG. 5 when viewed from the left-hand side.
Figure 7:
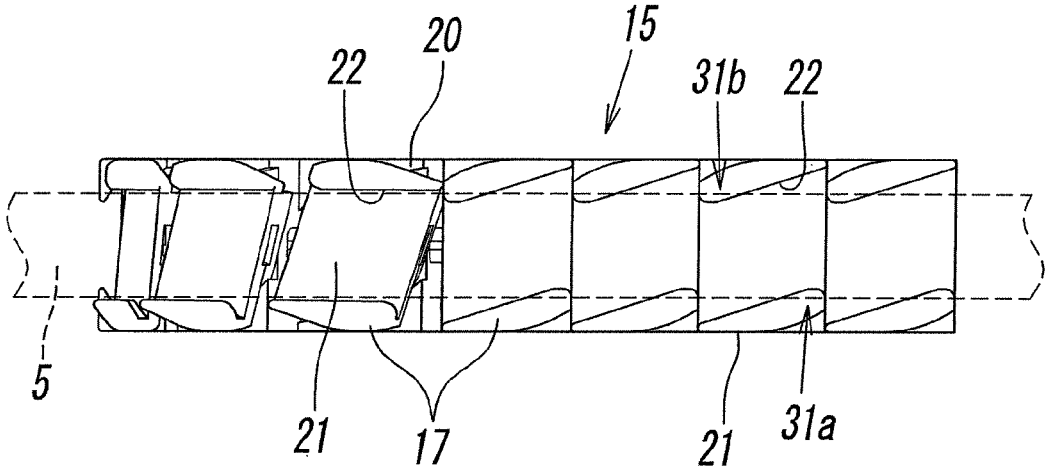
FIG. 7 is a bottom view of the screen guide illustrated in FIG. 6.

As is clear from FIG. 5 and FIG. 6, the screen guide 15 is formed by connecting a plurality of guide pieces 17 each made of a synthetic resin to one another in series such that the screen guide 15 is capable of being bent only in one direction. As illustrated in FIG. 1, a first end 15*a* of the screen guide 15 is fixed to a lower end portion of the first vertical-frame pole 2*a*, and a second end 15*b* of the screen guide 15 is introduced into the screen-guide accommodating portion 4*c* through an opening 4*a* formed at the lower end of the operating stile 4 and is connected to a first end 18*a* of a mounting wire 18. A second end 18*b* of the mounting wire 18 is led out from the upper end of the operating stile 4 to the inside of the first horizontal-frame pole 3*a* and fixed to the first horizontal-frame pole 3*a*. The screen guide 15 is disposed in this manner, so that the screen guide 15 is drawn out from the inside of the operating stile 4 along the end portion of the screen 8 and is drawn into the inside of the operating stile 4 as the operating stile 4 is operated to move side to side.

As is clear from FIG. 8 to FIG. 11, each of the guide pieces 17 is formed by connecting an upper piece body 20 that engages the lower end portion of the screen 8 and a lower engagement member 21 that has a support groove 22, which is formed in a recessed manner in a bottom surface of the lower engagement member 21 and into which the support rail 5 is fitted, to each other such that the piece body 20 and the engagement member 21 are capable of rotating relative to each other in both forward and reverse directions about a vertical axis L that passes through the center of the guide piece 17. The shape of each of the guide pieces 17 in plan view is a rectangle that has a diameter Y in a left-right direction (indoor-outdoor direction) and a diameter X in a front-rear direction (connecting direction), the diameter Y being larger than the diameter X.

Note that "front and rear" and "left and right" of each of the guide pieces 17 are defined, as illustrated in FIG. 8, when an end of the guide piece 17 in the connecting direction is viewed as a front surface.

Each of the piece bodies 20 has a pair of wire insertion holes 24 and 24 that are formed at positions in the vicinity of an upper end of the piece body 20 in the height direction of the piece body 20, the positions being close to the opposite ends of the piece body 20 in the left-right direction, and the wire insertion holes 24 and 24 extend through the piece body 20 in the front-rear direction from a first end E1 to a second end E2 that is opposite to the first end E1. As illustrated in FIG. 5 and FIG. 6, flexible wires 25 are each inserted into one of the wire insertion holes 24 and 24 such that the plurality of guide pieces 17 are connected in series to one another, so that the screen guide 15 is formed. By connecting the plurality of guide pieces 17 to one another in this manner, the screen guide 15 can be bent only in a direction in which the screen guide 1 forms a concave shape on the top surface side thereof.

A slit-shaped engagement groove 27 is formed in a center portion of the top surface of each of the piece bodies 20 in the left-right direction so as to extend through the piece body 20 from the first end E1 to the second end E2, and an engagement member 26 (see FIG. 1 and FIG. 4) formed at the lower end portion of the screen 8 is fitted into and engages each of the slit-shaped engagement grooves 27. An expanded portion 27*a* is formed at an inner end of each of the engagement grooves 27, the expanded portion 27*a* having a width larger than that of the engagement groove 27.

As is clear from FIG. 4, the engagement member 26 is formed by fixing an engagement body 26*a* having a plurality of protrusions to an end of a tape-shaped base member 26*b*, and the base member 26*b* is joined to the lower end portion of the screen 8 by means of, for example, welding or sewing.

When the screen guide 15 is drawn out through the opening 4*a*, which is formed at the lower end of the operating stile 4, along the lower end portion of the screen 8, the engagement member 26 is fitted into the engagement grooves 27 of the piece bodies 20 that are drawn out, and the engagement body 26*a* engages inner edges of the engagement grooves 27 in the expanded portions 27*a*, so that the screen 8 sequentially engages the guide pieces 17. On the other hand, when the screen guide 15 is drawn into the inside of the operating stile 4, the engagement member 26 is disengaged from the engagement grooves 27 of the piece bodies 20 that are drawn in.

In contrast, each of the engagement members 21 is a member whose shape in plan view is substantially the same as the shape of each of the piece bodies 20 in plan view and is substantially the same size as each of the piece bodies 20. Each of the engagement members 21 is coupled to the bottom surface of a corresponding one of the piece bodies 20 by a coupling mechanism 30 so as to be capable of rotating about the axis L between a first position A (FIG. 9(*a*)) and a second position B (FIG. 9(*b*)) and has the support groove 22 formed in the bottom surface thereof.

Figure 9:
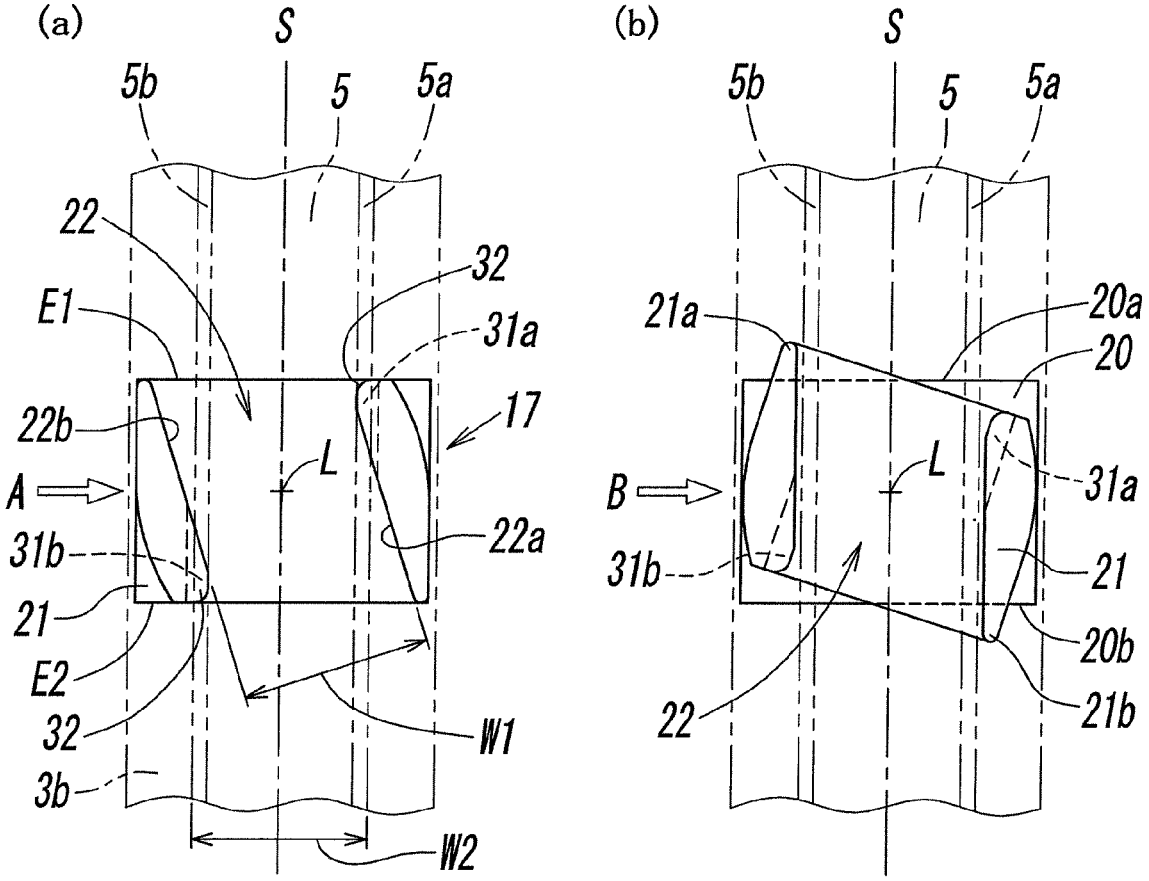
FIG. 9(*a*) is a bottom view when an engagement member one of the guide pieces is located on a first position, and FIG. 9(*b*) is a bottom view when the engagement member of the guide piece is located on a second position.

As is clear from FIG. 8 and FIG. 9, each of the support grooves 22 is formed such that when one of the engagement members 21 is not rotating with respect to the corresponding piece body 20, that is, when the engagement member 21 is located at the first position A, the corresponding support groove 22 is oriented in an oblique direction with respect an imaginary plane S dividing the guide pieces 17 into two portions in the left-right direction and such that when one of the engagement members 21 rotates with respect to the corresponding piece body 20, that is, when the engagement member 21 is located at the second position B, the corresponding support groove 22 is parallel to the imaginary plane S. In other words, the imaginary plane S and the support rail 5 are parallel to each other, and thus, it can also be said that each of the support grooves 22 is formed so as to be oriented in the oblique direction with respect the support rail 5 at the first position A and so as to be parallel to the support rail 5 at the second position B.

Note that the axis L is located within the imaginary plane S.

When one of the engagement members 21 is located at the first position A, the engagement member 21 is oriented in the same direction as that in which the corresponding piece body 20 is oriented, and thus, the engagement member 21 and the piece body 20 are superposed with each other. When the engagement member 21 rotates to the second position B, the engagement member 21 is oriented in a different direction from that in which the corresponding piece body 20 is oriented, and thus, corner portions 21*a* and 21*b* of the engagement member 21 in a diagonal direction respectively project from end surfaces 20*a* and 20*b* of the piece body 20.

In addition, a groove width W1 of each of the support grooves 22 is slightly larger than a width W2 (the width in the front-rear direction) of the support rail 5. Thus, when one of the engagement members 21 is located at the first position A, a portion of a first groove wall 22*a*, which is one of a pair of opposing groove walls of the corresponding support groove 22, is in contact with the first engagement edge 5*a* of the support rail 5, and a portion of a second groove wall 22*b*, which is the other of the pair of opposing groove walls, is in contact with the second engagement edge 5*b* of the support rail 5. Accordingly, engagement portions 31*a* and 31*b* that engage the engagement edges 5*a* and 5*b*, respectively, are formed at the contact portions. In other words, the first engagement portion 31*a* is formed on the portion of each of the first groove walls 22*a* that comes into contact with the corresponding first engagement edge 5*a*, and the second engagement portion 31*b* is formed on the portion of each of the second groove walls 22*b* that comes into contact with the corresponding second engagement edge 5*b*. In the case illustrated in FIG. 8, the first engagement portion 31*a* is formed on the side on which the first end E1 of each of the guide pieces 17 is present, and the second engagement portion 31*b* is formed on the side on which the second end E2 of each of the guide pieces 17 is present.

As seen from FIG. 8, the first engagement portion 31*a* and the second engagement portion 31*b* include engagement hooks 32 projecting inward in the widthwise direction of the support groove 22. Inner surfaces 32*a* of the engagement hooks 32 that face a groove bottom 22*c* and outer surfaces 32*b* of the engagement hooks 32 that are opposite to the inner surfaces 32*a* are inclined surfaces that are each inclined in a direction in which the thickness of the corresponding engagement hook 32 gradually decreases toward an end of the engagement hook 32.

Figure 10:
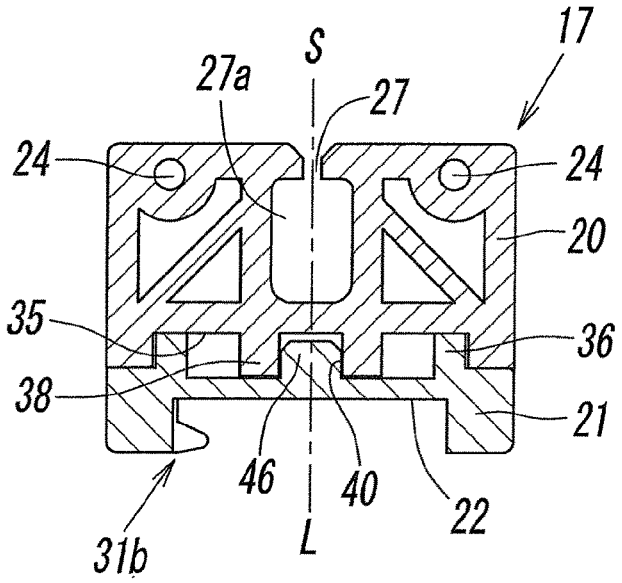
FIG. 10 is a sectional view of one of the guide pieces.
Figure 11:
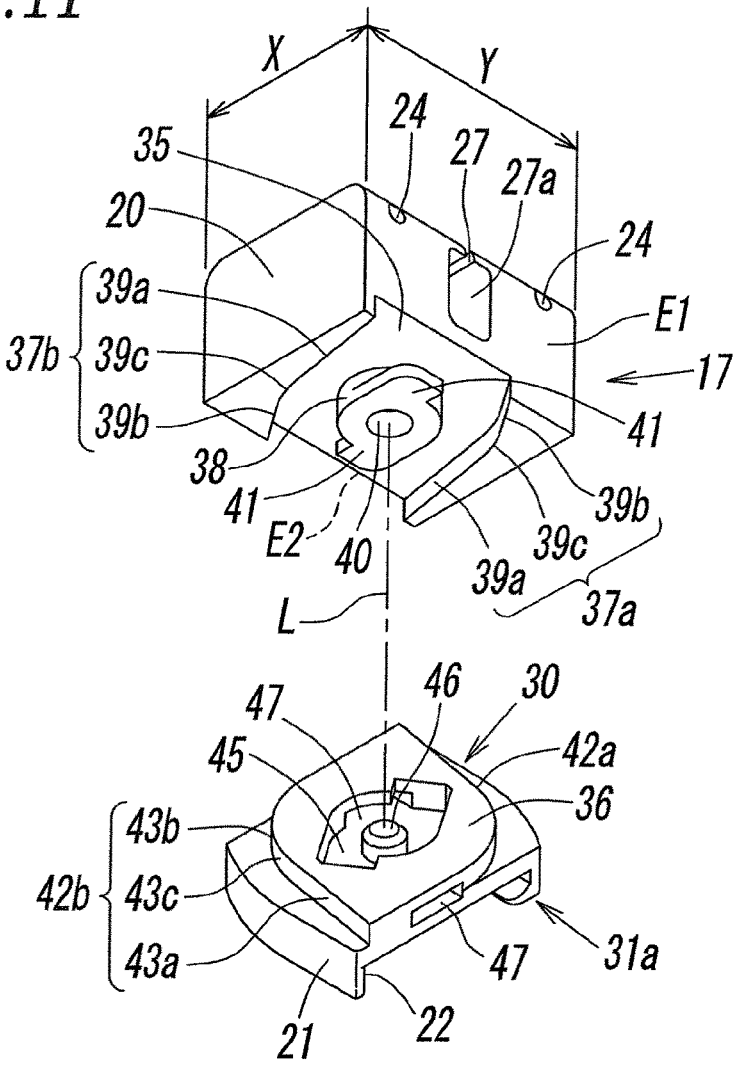
FIG. 11 is a perspective view of a piece body of one of the guide pieces and the engagement member of the guide piece that are separated from each other.

As is clear from FIG. 10 and FIG. 11, the coupling mechanisms 30 coupling the piece bodies 20 and the corresponding engagement members 21 to each other each have a coupling recess 35 that is formed in a recessed manner in the bottom surface of the piece body 20 and a coupling protrusion 36 that is formed on the top surface of the engagement member 21 and that is fitted into the coupling recess 35.

The coupling recess 35 is formed between a pair of opposing recess side walls 37*a* and 37*b*, and a bearing portion 38 is disposed at the center of the coupling recess 35.

The first recess side wall 37*a*, which is one of the pair of opposing recess side walls 37*a* and 37*b*, has a first inclined portion 39*a* extending linearly from the second end E2 of the piece body 20 to a position near the first end E1 while being inclined in a direction in which the first inclined portion 39*a* gradually comes closer to the imaginary plane S, a second inclined portion 39*b* extending from an end portion of the first inclined portion 39*a* to the first end E1, and an arc-shaped connecting portion 39*c* connecting the first inclined portion 39*a* and the second inclined portion 39*b* to each other in a curved and smooth manner. The inclination angle of the second inclined portion 39*b* with respect to the imaginary plane S is larger than the inclination angle of the first inclined portion 39*a* with respect to the imaginary plane S. In contrast, the second recess side wall 37*b*, which is the other one of the pair of opposing recess side walls 37*a* and 37*b*, is formed so as to be line-symmetrical to the first recess side wall 37*a* with respect to the axis L.

The bearing portion 38 is formed in a columnar shape and has a bearing hole 40 formed at a position on the axis L that passes through the center of the bearing portion 38 and two positioning protrusions 41 and 41 respectively protruding toward the first end E1 and the second end E2 of the piece body 20 from the side surface of the column.

In contrast, the coupling protrusion 36 of the engagement member 21 has a first protrusion side wall 42*a* and a second protrusion side wall 42*b* that respectively come into contact with the first recess side wall 37*a* and the second recess side wall 37*b*. The first protrusion side wall 42*a* and the second protrusion side wall 42*b* each have a first inclined portion 43*a*, a second inclined portion 43*b*, and a connecting portion 43*c* that respectively correspond to the first inclined portion 39*a*, the second inclined portion 39*b*, and the connecting portion 39*c*, and the connecting portion 43*c* is formed in an arc shape.

A recessed bearing fitting portion 45 into which the bearing portion 38 is fitted is formed in the top surface of the coupling protrusion 36, and a coupling shaft 46 that is positioned at the center of the bearing fitting portion 45 and that is fitted into the bearing hole 40 is formed on the top surface of the coupling protrusion 36. In a side wall of the bearing fitting portion 45, two positioning holes 47 and 47 into which the two positioning protrusions 41 and 41 are rotatably fitted are formed at positions facing each other with the coupling shaft 46 interposed therebetween.

When the engagement member 21 rotates about the coupling shaft 46 (the axis L) with respect to the piece body 20, the positioning protrusions 41 are displaced within the corresponding positioning holes 47. When each of the positioning protrusions 41 comes into contact with one of left and right hole walls of the corresponding positioning hole 47, the engagement member 21 occupies the first position A, and when the positioning protrusion 41 comes into contact with the other one of the left and right hole walls, the engagement member 21 occupies the second position B.

FIG. 1 illustrates an intermediate open state, in the screen device having the above-described configuration, in which the operating stile 4 that is operated is located at an intermediate position between the open position and the closed position. From this state, when the operating stile 4 is moved in the direction toward the right-hand side in FIG. 1 (in an opening direction), the screen 8 is wound up by the winding shaft 7, and the screen guide 15 is drawn into the operating stile 4, so that the screen frame 1 is opened. Conversely, when the operating stile 4 is moved in the direction toward the left-hand side in FIG. 1 (in a closing direction), the screen 8 is extended from the winding shaft 7, and the screen guide 15 is drawn out from the inside of the operating stile 4, so that the screen frame 1 is closed.

In this case, in the screen guide 15, when the operating stile 4 is moved in the direction toward the right-hand side, the guide pieces 17 that have engaged, in a horizontal position, the support rail 5 are sequentially detached from the support rail 5 and drawn into the operating stile 4 while the orientation thereof is gradually changed toward a longitudinal direction (the vertical direction) starting from the guide piece 17 that is located closest to the operating stile 4. Conversely, when the operating stile 4 is moved in the direction toward the left-hand side, the guide pieces 17 that are drawn out from the inside of the operating stile 4 onto the support rail 5 engages the support rail 5 while the orientation of each of the guide pieces 17 is gradually changed such that the position of the guide piece 17 is changed from a vertical position to a position when the screen guide 15 is bent and then to a horizontal position along the support rail 5. Operation of each of the guide pieces 17 in this case will be described below.

Figure 12:
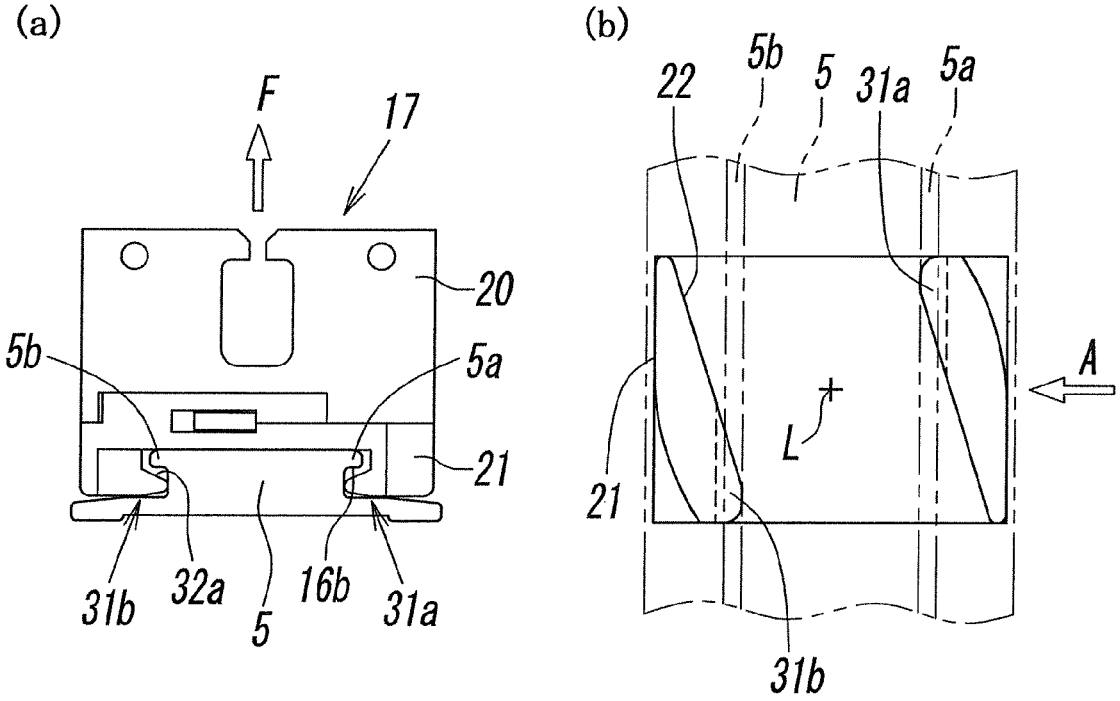
FIG. 12(*a*) is a front view illustrating a state where one of the guide pieces has engaged the support rail, and FIG. 12(*b*) is a bottom view illustrating the same state.
Figure 13:
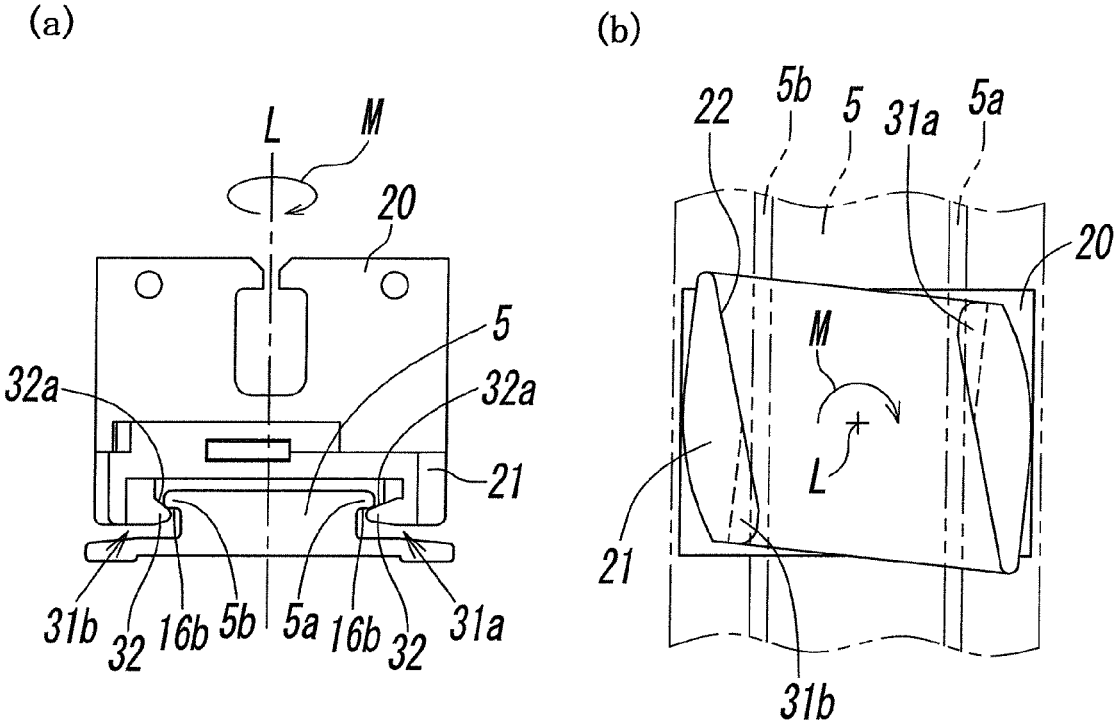
FIG. 13(*a*) is a front view illustrating an intermediate state in a process in which one of the guide pieces is detached from the support rail, and FIG. 13(*b*) is a bottom view illustrating the same state.
Figure 14:
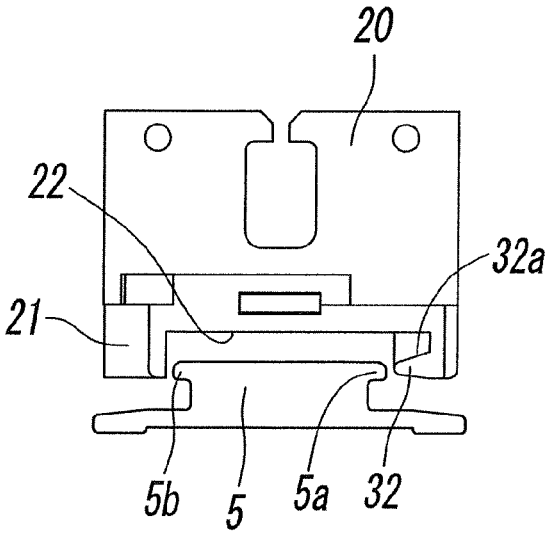
FIG. 14(*a*) is a front view illustrating a state where one of the guide pieces is detached from the support rail, and FIG. 14(*b*) is a bottom view illustrating the same state.
Figure 14:
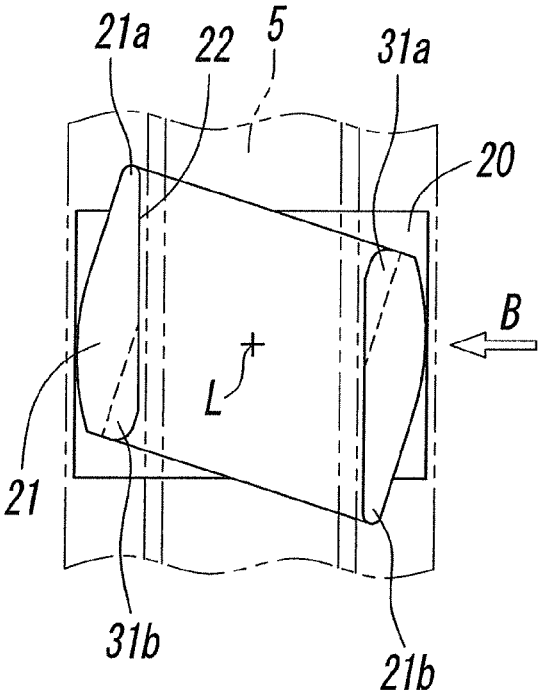

FIG. 12 to FIG. 14 illustrate the operation of each of the guide pieces 17 when the guide piece 17 is detached from the support rail 5. As illustrated in FIGS. 12(*a*) and 12(*b*), in a state where the engagement member 21 of the guide piece 17 is located at the first position A and where the first engagement portion 31*a* and the second engagement portion 31*b* have engaged the first engagement edge 5*a* and the second engagement edge 5*b* of the support rail 5, respectively, when an upward force F acts on the guide piece 17, as illustrated in FIGS. 13(*a*) and 13(*b*), the inner surface 32*a* of the engagement hook 32 of the first engagement portion 31*a* and the inner surface 32*a* of the engagement hook 32 of the second engagement portion 31*b* respectively come into contact with the rear surface 16*b* of the first engagement edge 5*a* and the rear surface 16*b* of the second engagement edge 5*b*. In this case, since the inner surfaces 32*a* are inclined surfaces, a force that causes the engagement hooks 32 to be displaced along their inner surfaces 32*a* toward the ends of the corresponding engagement edges 5*a* and 5*b* is generated between the engagement hooks 32 and the engagement edges 5*a* and 5*b*. Then, a moment about the axis L is generated by this force and acts on the engagement member 21, and the engagement member 21 is caused by the moment to rotate in the direction of arrow M. Consequently, as illustrated in FIGS. 13(*a*) and 13(*b*), the engagement hooks 32 are displaced in a direction in which the engagement hooks 32 are detached from the corresponding engagement edges 5*a* and 5*b*.

The engagement member 21 keeps rotating, and thus, the engagement hooks 32 are displaced to positions where the engagement hooks 32 are completely detached from the corresponding engagement edges 5*a* and 5*b* as illustrated in FIGS. 14(*a*) and 14(*b*). As a result, the engagement member 21 occupies the second position B, and the support groove 22 is oriented approximately parallel to the support rail 5. Then, the guide piece 17 is lifted up by the upward force F and is detached from the support rail 5.

In the actual operation, as seen from FIG. 1 and FIG. 5 to FIG. 7, the upward force F acts on the second end E2 of each of the guide pieces 17, and thus, the above-described operation of each of the guide pieces 17 for being detached from the support rail 5 is mainly performed on the side on which the second end E2 is present.

The guide pieces 17 that have been detached from the support rail 5 and drawn into the operating stile 4 gradually change their orientations toward the longitudinal direction from a bent state and are finally brought into a state of being vertically and consecutively aligned. In this case, when one of the guide pieces 17 is still in the bent position, the engagement member 21 of the guide piece 17 occupies the second position B, and the corner portions 21*a* and 21*b* of the engagement member 21 respectively project from the first end E1 and the second end E2 of the guide piece 17. One of these projecting portions comes into contact with and is pushed by the preceding guide piece 17, and thus, the engagement member 21 returns to the first position A. The guide piece 17 in this state is linearly continuous with the other guide pieces 17.

Figure 15:
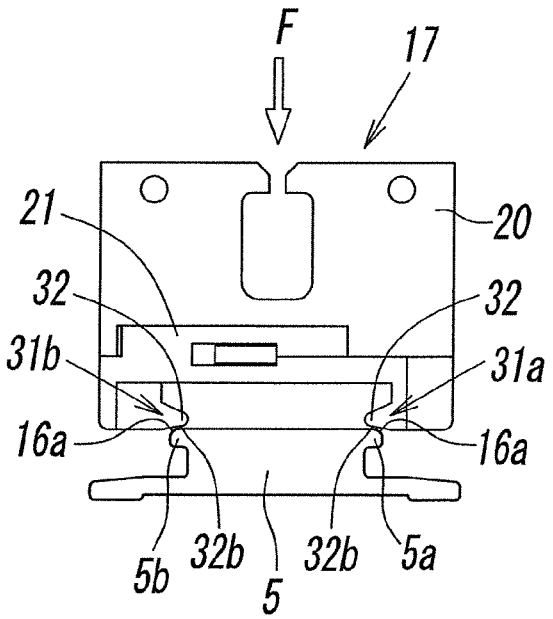
FIG. 15(*a*) is a front view illustrating an initial state in a process in which one of the guide pieces engages the support rail, and FIG. 15(*b*) is a bottom view illustrating the same state.
Figure 15:
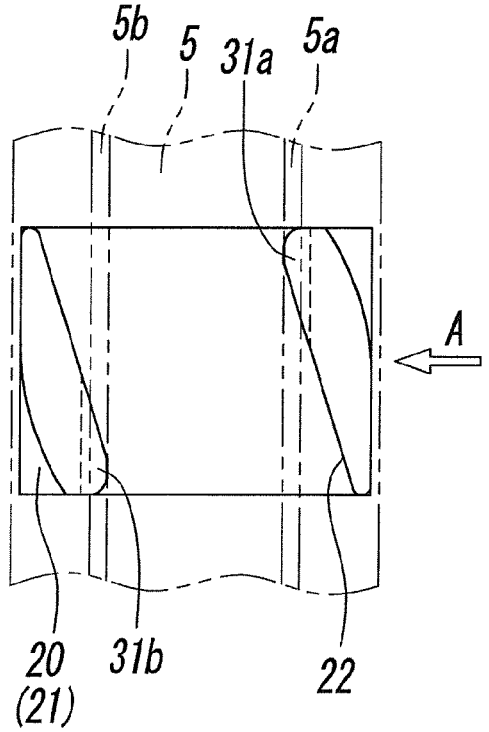
Figure 16:
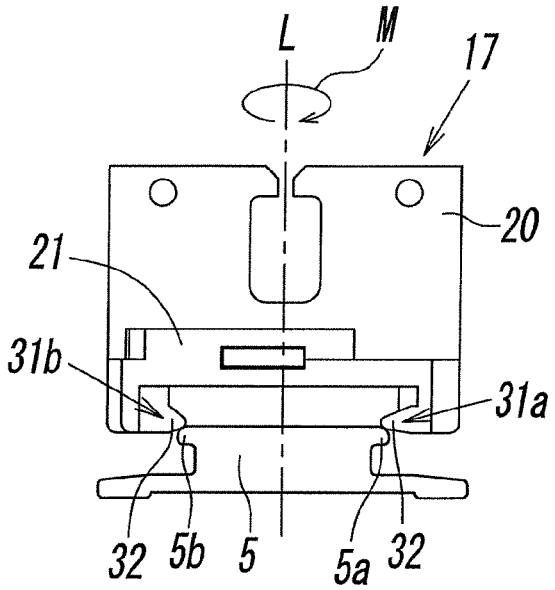
FIG. 16(*a*) is a front view illustrating an intermediate state in a process in which one of the guide pieces engages the support rail, and FIG. 16(*b*) is a bottom view illustrating the same state.
Figure 16:
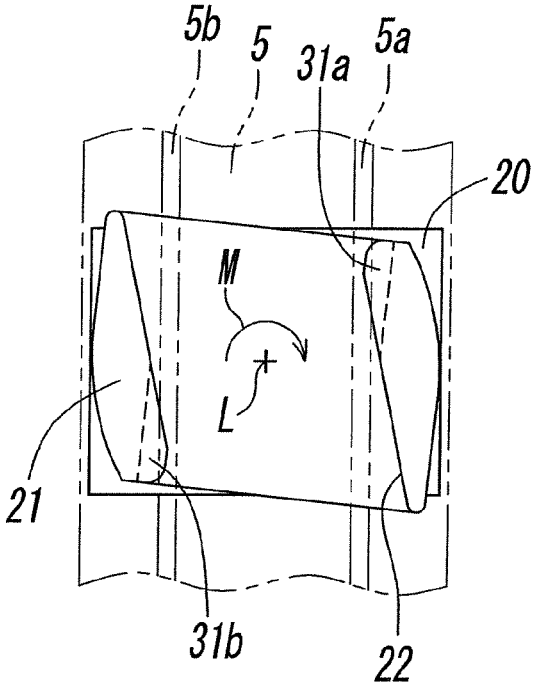

FIG. 15 to FIG. 18 illustrate the operation of each of the guide pieces 17 when the guide piece 17 engages the support rail 5. As illustrated in FIGS. 15(*a*) and 15(*b*), when a downward force F acts on one of the guide pieces 17 in a state where the engagement member 21 of the guide piece 17 is located at the first position A, the outer surface 32*b* of the engagement hook 32 of the first engagement portion 31*a* of the engagement member 21 and the outer surface 32*b* of the engagement hook 32 of the second engagement portion 31*b* of the engagement member 21 respectively come into contact with a front surface 16*a* of the first engagement edge 5*a* of the support rail 5 and a front surface 16*a* of the second engagement edge 5*b* of the support rail 5. In this case, since the outer surfaces 32*b* are inclined surfaces, as illustrated in FIGS. 16(*a*) and 16(*b*), a force that causes the engagement hooks 32 to be displaced along their outer surfaces 32*b* toward the ends of the corresponding engagement edges 5*a* and 5*b* is generated between the engagement hooks 32 and the engagement edges 5*a* and 5*b*. Then, a moment about the axis L is generated by this force and acts on the engagement member 21, and the engagement member 21 is caused by the moment to rotate in the direction of arrow M. Consequently, the engagement hooks 32 are displaced in a direction in which the engagement hooks 32 are detached from the corresponding engagement edges 5*a* and 5*b*.

Figure 17:
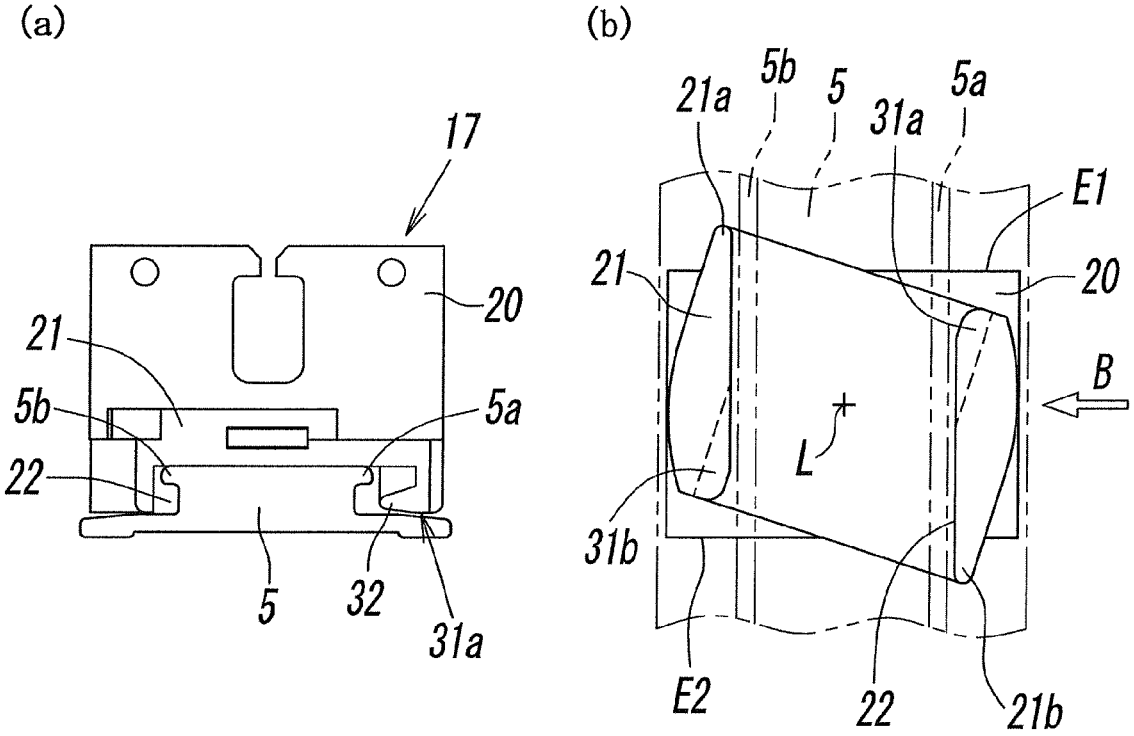
FIG. 17(*a*) is a front view illustrating a state immediately before one of the guide pieces engages the support rail, and FIG. 17(*b*) is a bottom view illustrating the same state.

The engagement member 21 keeps rotating, and thus, the engagement hooks 32 are displaced to positions where the engagement hooks 32 are completely detached from the corresponding engagement edges 5*a* and 5*b*, after which the guide piece 17 is displaced to a position where the support rail 5 is fitted into the support groove 22 as illustrated in FIGS. 17(*a*) and 17(*b*). In this case, the engagement member 21 is located at the second position B, and the support groove 22 is approximately parallel to the support rail 5. In addition, the corner portions 21*a* and 21*b* of the engagement member 21 project outward from the first end E1 and the second end E2 of the guide piece 17, respectively.

Figure 18:
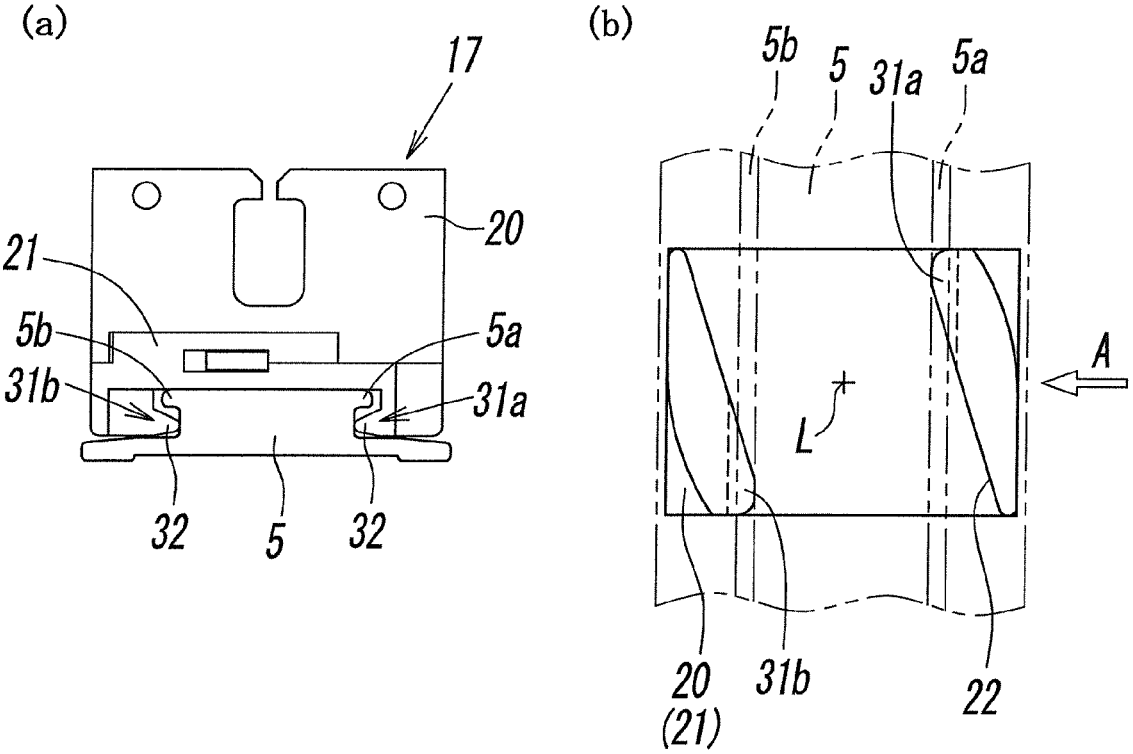
FIG. 18(*a*) is a front view illustrating a state where one of the guide pieces has engaged the support rail, and FIG. 18(*b*) is a bottom view illustrating the same state.

Next, the guide piece 17 follows the preceding guide piece 17 such that the guide pieces 17 are consecutively aligned along the support rail 5 (see FIG. 4 to FIG. 7), and in this case, the corner portion 21*a* projecting from the first end E1 of the engagement member 21 comes into contact with and is pushed by an end surface on the second end E2 side of the preceding guide piece 17, so that the engagement member 21 rotates and returns to the first position A. This brings the guide piece 17 into a state in which the engagement hooks 32 of the first and second engagement portions 31*a* and 31*b* of the engagement member 21 engage the first and second engagement edges 5*a* and 5*b* of the support rail 5 as illustrated in FIGS. 18(*a*) and 18(*b*).

In the actual operation, as seen from FIG. 1 and FIG. 5 to FIG. 7, the downward force F acts on the first end E1 of each of the guide pieces 17 first, and thus, the above-described operation of each of the guide pieces 17 for engaging the support rail 5 is mainly performed on the side on which the first end E1 is present.

Regarding the guide pieces 17 consecutively aligned along the support rail 5, adjacent ones of the guide pieces 17 and 17 in the front-rear direction are brought into close contact with each other, so that the locking members 21 are each restrained at the first position A, and thus, even if an upward force acts on the guide pieces 17 via the screen 8, the engagement members 21 will not be able to rotate toward the second position B. Therefore, the guide pieces 17 will not be detached from the support rail 5.

In the manner described above, each of the guide pieces 17 of the screen guide 15 engages or is detached from the support rail 5 at an intermediate position on the support rail 5.

Figure 19:
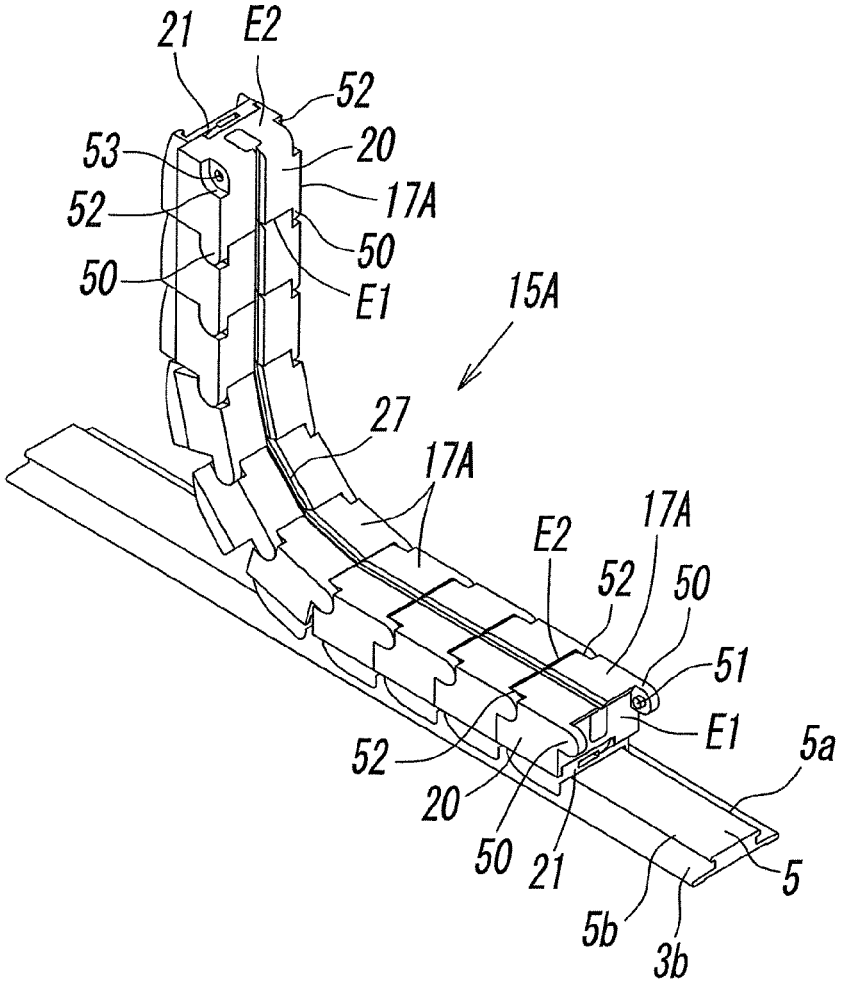
FIG. 19 is a partial perspective view illustrating a first modification the screen guide.

FIG. 19 illustrates a first modification of the above-described screen guide, and in a screen guide 15A of the first modification, a plurality of guide pieces 17A are consecutively connected to one another by pins.

In other words, pairs of connecting arms 50 and 50 are formed on end surfaces of the piece bodies 20 of the guide pieces 17A, the end surfaces being located on the first end E1 side, such that each pair of the connecting arms 50 and 50 project in the lengthwise direction of the screen guide 15A from opposing positions on an upper end portion of the end surface in the left-right direction, and each of the connecting arms 50 and 50 is provided with a connecting pin 51. Pairs of arm receivers 52 and 52 each of which is in the form of a recessed step portion are formed in end surfaces of the piece bodies 20, the end surfaces being located on the second end E2 side, such that each pair of the arm receivers 52 and 52 are located at opposing positions on an upper end portion of the end surface in the left-right direction, and a pin hole 53 is formed in each of the arm receivers 52 and 52.

The screen guide 15A is formed by consecutively and rotatably connecting adjacent ones of the guide pieces 17A and 17A to each other with the corresponding connecting pins 51 and the corresponding pin holes 53.

The rest of the configuration of the screen guide 15A other than the above-described configuration is substantially the same as that of the screen guide 15 according to the basic embodiment illustrated in FIG. 1 to FIG. 18. Thus, the same main elements as in the screen guide 15 according to the basic embodiment are denoted by the same reference signs used in the screen guide 15, and descriptions thereof will be omitted.

Figure 20:
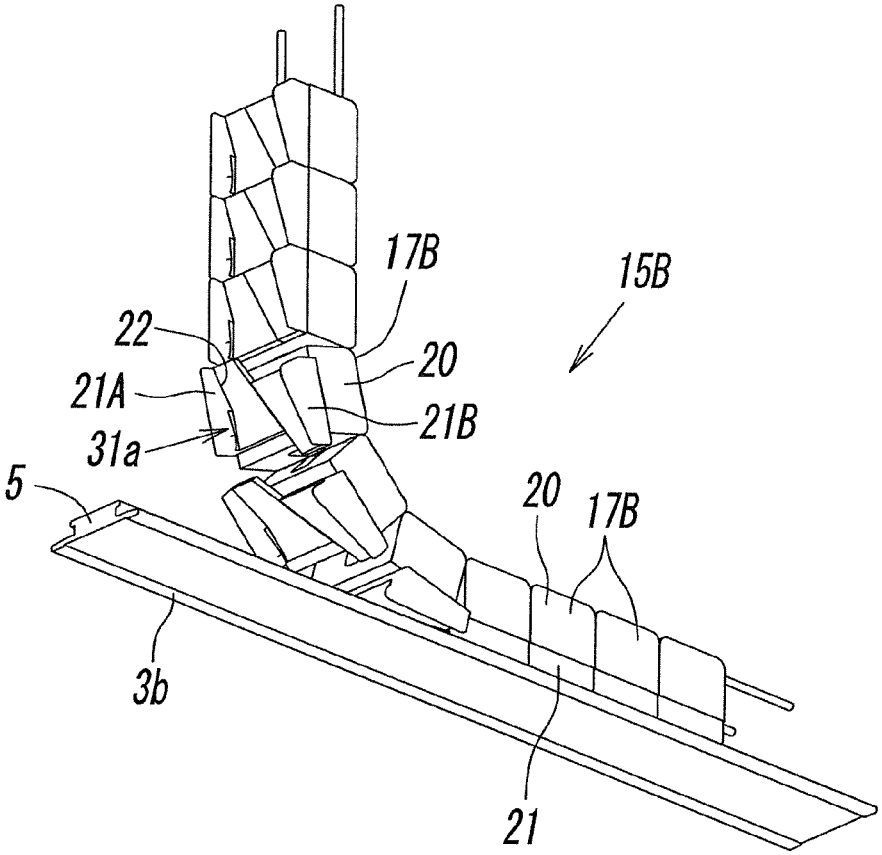
FIG. 20 is a partial perspective view illustrating a second modification the screen guide.
Figure 21:
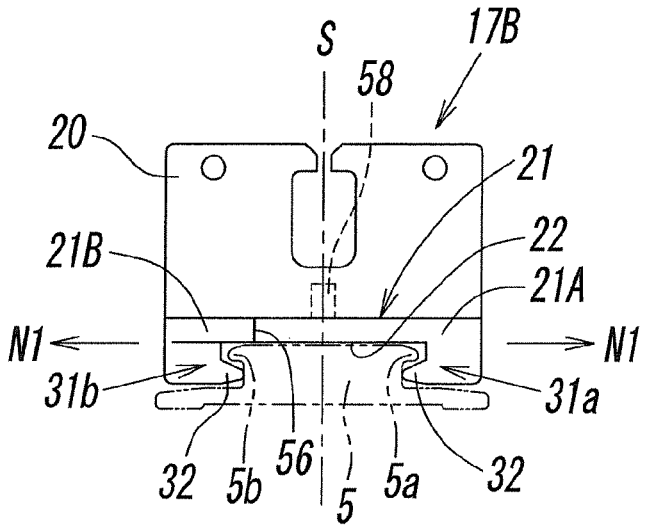
FIG. 21(*a*) is a front view of one of guide pieces included in the screen guide of the second modification, and FIG. 21(*b*) is a bottom view illustrating the same state.
Figure 21:
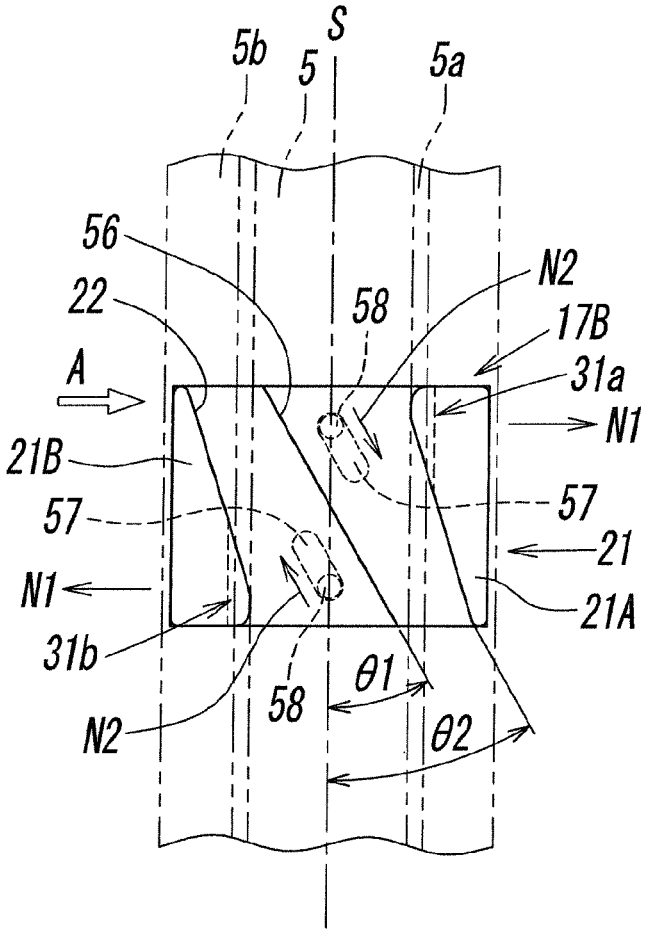
Figure 22:
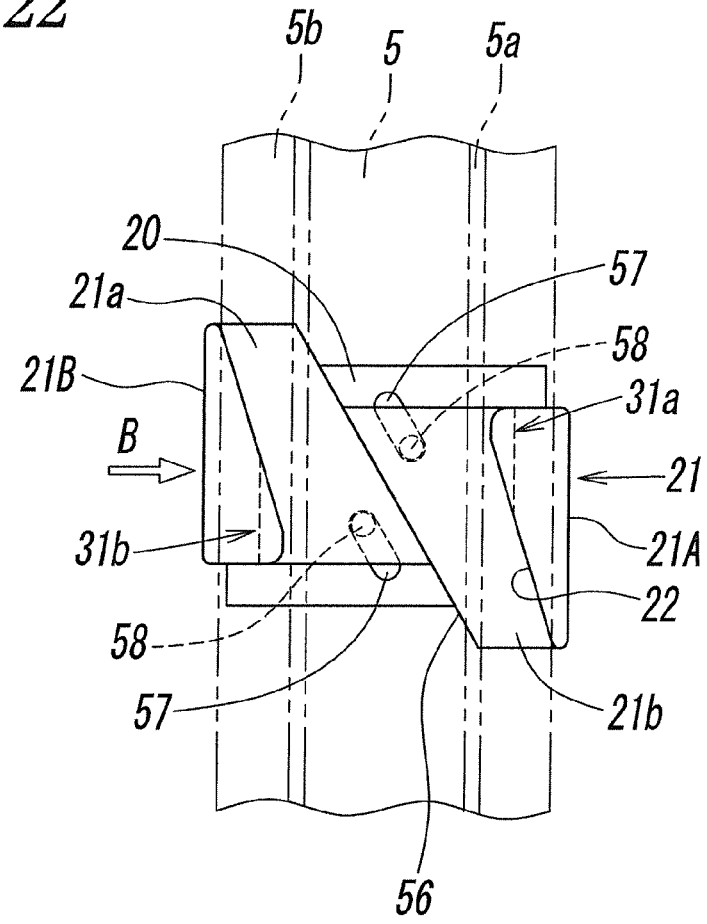
FIG. 22 is a bottom view illustrating a state where the guide piece illustrated in FIG. 20 is detached from the support rail.
Figure 23:
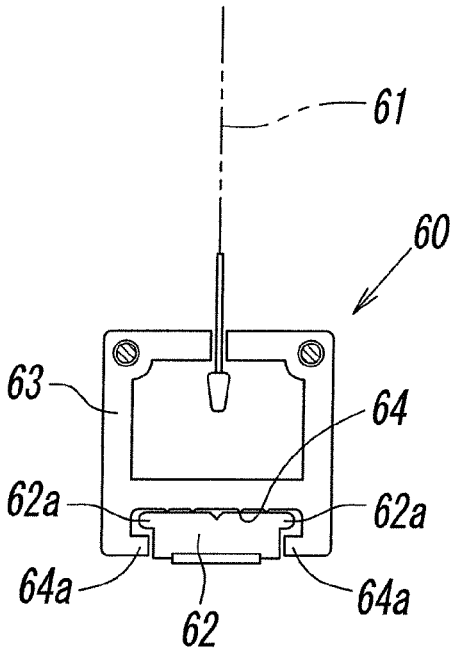
FIG. 23 is a sectional view illustrating the relationship between a guide piece and a rail in a commonly known screen guide.

FIG. 20 to FIG. 22 illustrate a second modification of the screen guide, and in guide pieces 17B that are included in a screen guide 15B of the second modification, the engagement members 21 each have a configuration different from the configuration of each of the engagement members 21 of the guide pieces 17 in the screen guide 15 according to the basic embodiment.

In other words, the engagement members 21 of the guide pieces 17B each have a pair of sliding pieces 21A and 21B that are capable of being displaced in an oblique direction with respect to the support rail 5 and in opposite directions relative to each other. The pair of sliding pieces 21A and 21B have shapes resembling two portions into which the rectangular engagement member 21 is divided along a sliding contact surface 56 crossing the imaginary plane S. The pair of sliding pieces 21A and 21B are mounted on the bottom surface of the piece body 20 so as to be capable of being displaced to the first position A (FIG. 21 (b)) and to the second position B (FIG. 22) by inserting sliding pins 58 formed on the top surfaces of the sliding pieces 21A and 21B into a pair of elongated sliding holes 57 formed in the bottom surface of the piece body 20 such that the sliding pins 58 are capable of being freely displaced, the pair of elongated sliding holes 57 being parallel to the sliding contact surface 56 and being parallel to each other. In addition, the support groove 22 is formed between the pair of sliding pieces 21A and 21B, and the first engagement portion 31*a* and the second engagement portion 31*b* are respectively formed on the first sliding piece 21A and the second sliding piece 21B.

An angle θ1 formed by the sliding contact surface 56 and the imaginary plane S is larger than an angle θ2 formed by the support groove 22 and the imaginary plane S.

In addition, an anti-rotation mechanism (not illustrated) is provided in order to prevent the pair of sliding pieces 21A and 21B from rotating about the corresponding sliding pins 58.

The rest of the configuration of each of the guide pieces 17B other than the above-described configuration is substantially the same as that of each of the guide pieces 17 of the screen guide 15 according to the basic embodiment. Thus, the same main elements as in the guide pieces 17 are denoted by the same reference signs used in the guide pieces 17 of the screen guide 15 according to the basic embodiment, and descriptions thereof will be omitted.

When one of the guide pieces 17B having the above-described configuration engage the support rail 5, as illustrated in FIGS. 21(*a*) and 21(*b*), the corresponding engagement member 21 occupies the first position A, so that the engagement hook 32 of the first engagement portion 31*a* of the first sliding piece 21A and the engagement hook 32 of the second engagement portion 31*b* of the second sliding piece 21B respectively engage the first engagement edge 5*a* and the second engagement edge 5*b* of the support rail 5.

In this state, when an upward force acts on the guide piece 17B, and the guide piece 17B is detached from the support rail 5, as in each of the guide pieces 17 according to the basic embodiment that have been described with reference to FIG. 13, a force in an N1 direction (see FIG. 21(*a*)) acts on the sliding pieces 21A and 21B by the interaction between the inner surfaces 32*a* of the engagement hooks 32 and the engagement edges 5*a* and 5*b*. This force is changed to a force in an N2 direction by the corresponding sliding holes 57 and the corresponding sliding pins 58, and thus, as illustrated in FIG. 22, the pair of sliding pieces 21A and 21B are displaced in opposite directions along the sliding contact surface 56 and are each moved to the second position B. Consequently, the guide piece 17 is detached from the support rail 5.

When the guide piece 17 is pressed against the top surface of the support rail 5 and engages the support rail 5, the pair of the sliding pieces 21A and 21B of the engagement member 21 located at the first position A are each temporarily displaced to the second position B illustrated in FIG. 22 by the interaction between the engagement hooks 32 and the engagement edges 5*a* and 5*b* of the support rail 5. After the support rail 5 has been fitted to the support groove 22, projecting portions of the sliding pieces 21A and 21B are pushed by the other guide pieces 17 that are adjacent to the guide piece 17 in the front-rear direction, so that the sliding members each return to the first position A illustrated in FIG. 21, and as a result, the guide piece 17 engages the support rail 5.

Note that the pair of sliding pieces 21A and 21B may be configured to be displaced linearly in the force N1 direction (in the left-right direction) or may be configured to be opened and closed transversely like a clip. In this case, the engagement hooks may be provided not at end portions of the sliding pieces 21A and 21B but at center portions of the sliding pieces 21A and 21B or may be provided across the entire sliding pieces 21A and 21B.

In the above-described embodiment, in each of the guide pieces 17, both the inner surfaces 32*a* and the outer surfaces 32*b* of the engagement hooks 32 of the first and second engagement portions 31*a* and 31*b* are inclined surfaces. In addition, the front surfaces 16*a* of the first and second engagement edges 5*a* and 5*b* of the support rail 5 are inclined surfaces, and the rear surfaces 16*b* of the first and second engagement edges 5*a* and 5*b* of the support rail 5 are horizontal surfaces. However, the present invention is not limited to such a case, and regarding the inner surfaces 32*a* of the engagement hooks 32 and the corresponding rear surfaces 16*b* of the engagement edges 5*a* and 5*b* that engage each other, at least one of either the inner surfaces 32*a* or the rear surfaces 16*b* may be inclined surfaces. Similarly, at least one of either the outer surfaces 32*b* and the front surfaces 16*a* may be inclined surfaces.

In addition, in the screen device of the above-described embodiment, although the screen guide 15 is only provided at the lower end side of the screen 8, the screen guide 15 may be provided at the upper end side of the screen 8 or may be provided at both the lower end side and the upper end side of the screen 8.

The present invention can be applied not only to a winding-type screen device using a planar screen such as that described in the above embodiment but also to, for example, a screen, such as that disclosed in Patent Literature 2, that is capable of expanding and contracting in an accordion fashion or a screen device using a screen or the like that has a honeycomb-shaped sectional structure. In this case, although a screen and guide pieces of a screen guide engage each other while an end portion of the screen is fitted into recessed grooves of the guide pieces, this engagement may sometimes be different from the engagement in which the screen and the guide pieces are connected to each other by means such as the engagement member 26.

The invention claimed is:

1. A screen device comprising:

a screen frame that is installed in a building opening;

an operating stile that is vertically disposed in the screen frame and is capable of being operated to move side to side;

a screen that is stretched between one of left and right vertical-frame poles of the screen frame and the operating stile and configured to open and close the screen frame as a result of the operating stile being operated and moved;

a screen guide that is provided on at least one of upper and lower ends of the screen and that is drawn out from an inside of the operating stile along an end portion of the screen and is drawn into the inside of the operating stile as a result of the operating stile being operated and moved; and a support rail that linearly supports, along the screen, the screen guide that is drawn out from the inside of the operating stile, wherein the support rail includes, along a longitudinal direction of the support rail, a first engagement edge and a second engagement edge that protrude in a widthwise direction of the support rail in such a manner as to face away from each other, wherein the screen guide is formed by connecting a plurality of guide pieces to one another in series, wherein each of the guide pieces includes a respective piece body that engages the end portion of the screen and a respective engagement member including, at a first side and a second side in a widthwise direction, a first engagement portion and a second engagement portion that engage the first engagement edge and the second engagement edge of the support rail, respectively, wherein the screen guide is formed so as to be capable of being bent to have a concave shape relative to a side where the piece bodies of the guide pieces are disposed, wherein the engagement member is coupled to the respective piece body in such a manner as to be capable of being displaced to a first position at which the first engagement portion and the second engagement portion engage the first engagement edge and the second engagement edge of the support rail, respectively, and to a second position at which the first engagement portion and the second engagement portion are respectively detached from engagement with the first engagement edge and the second engagement edge, and wherein the engagement member is configured to be displaced from the first position to the second position when the screen guide is drawn into the inside of the operating stile by the screen guide being bent over the support rail.

2. The screen device according to claim 1, wherein each of the engagement members has a recessed support groove into which the support rail is fitted, and wherein the first engagement portion is formed on a first groove wall, which is one of a pair of opposing groove walls of the support groove, and the second engagement portion is formed on a second groove wall, which is another one of the pair of opposing groove walls.

3. The screen device according to claim 2, wherein the first engagement portion and the second engagement portion include engagement hooks each projecting inward in a widthwise direction of the support groove so as to engage one of the first engagement edge and the second engagement edge, and wherein at least one of either inner surfaces of the engagement hooks or rear surfaces of the engagement edges and at least one of either outer surfaces of the engagement hooks or front surfaces of the engagement edges are inclined in directions in which thicknesses of the engagement hooks or thicknesses of the engagement edges gradually decrease toward ends of the engagement hooks or ends of the engagement edges.

4. The screen device according to claim 2, wherein the support groove is formed such that, when the screen guide is linearly supported along the support rail, the support groove is oriented in an oblique direction with respect to the support rail, and a portion of the first groove wall and a portion of the second groove wall, which oppose each other, are in contact with the first engagement edge and the second engagement edge, respectively, and wherein the first engagement portion is formed on the portion of the first groove wall that is brought into contact with the first engagement edge, and the second engagement portion is formed on the portion of the second groove wall that is brought into contact with the second engagement edge.

5. The screen device according to claim 3, wherein the support groove is formed such that, when the screen guide is linearly supported along the support rail, the support groove is oriented in an oblique direction with respect to the support rail, and a portion of the first groove wall and a portion of the second groove wall, which oppose each other, are in contact with the first engagement edge and the second engagement edge, respectively, and wherein the first engagement portion is formed on the portion of the first groove wall that is brought into contact with the first engagement edge, and the second engagement portion is formed on the portion of the second groove wall that is brought into contact with the second engagement edge.

6. The screen device according to claim 4, wherein each of the guide pieces has a first end and a second end, which is opposite to the first end, in the longitudinal direction, and wherein the first engagement portion is formed on one of the first end and the second end, and the second engagement portion is formed on another one of the first end and the second end.

7. The screen device according to claim 5, wherein each of the guide pieces has a first end and a second end, which is opposite to the first end, in the longitudinal direction, and wherein the first engagement portion is formed on one of the first end and the second end, and the second engagement portion is formed on another one of the first end and the second end.

8. The screen device according to claim 1, wherein the engagement member of each of the guide pieces is coupled to the corresponding piece body in such a manner as to be rotatable about an axis that is perpendicular to the corresponding guide piece and displaced, relative to the corresponding piece body, to the first position and to the second position by rotating in forward and reverse directions.

9. The screen device according to claim 1, wherein the engagement member of each of the guide pieces includes a pair of movable pieces that are capable of being displaced in opposite directions relative to one another in which a gap defined by the pair of movable pieces changes, and wherein the first engagement portion is formed on one of the pair of movable pieces, and the second engagement portion is formed on another one of the pair of movable pieces.

10. A screen-support mechanism supporting an end portion of a screen that is stretched in a screen frame of a screen device in such a manner as to be capable of being freely opened and closed, the screen-support mechanism comprising:

a screen guide that supports the end portion of the screen; and a support rail that supports the screen guide, wherein the support rail includes, along a longitudinal direction of the support rail, a first engagement edge and a second engagement edge that protrude in a widthwise direction of the support rail in such a manner as to face away from each other, wherein the screen guide is formed by connecting a plurality of guide pieces to one another in series, wherein each of the guide pieces includes a respective piece body that engages the end portion of the screen and a respective engagement member including, at a first side and a second side in a widthwise direction, a first engagement portion and a second engagement portion that engage the first engagement edge and the second engagement edge of the support rail, respectively, wherein the screen guide is formed so as to be capable of being bent to have a concave shape relative to a side where the piece bodies of the guide pieces are disposed, wherein the engagement member is coupled to the respective piece body in such a manner as to be capable of being displaced to a first position at which the first engagement portion and the second engagement portion engage the first engagement edge and the second engagement edge of the support rail, respectively, and to a second position at which the first engagement portion and the second engagement portion are respectively detached from engagement with the first engagement edge and the second engagement edge, and wherein the engagement member is configured to be displaced from the first position to the second position when the screen guide is drawn inside an operating stile by the screen guide being bent over the support rail.

* * * * *